US005806749A

United States Patent [19]

Chen

[11] Patent Number: 5,806,749

[45] Date of Patent: Sep. 15, 1998

[54] ADJUSTABLE TWIN STAPLER DEVICE

[76] Inventor: Chun-Ku Chen, 58, Ma Yuan West St., Taichung, Taiwan

[21] Appl. No.: 846,354

[22] Filed: Apr. 30, 1997

[51] Int. Cl.[6] ..... B25C 5/15; B25C 7/00

[52] U.S. Cl. ..... 227/131; 227/78; 227/110; 227/140; 227/156

[58] Field of Search ..... 227/78, 109, 110, 227/111, 119, 131, 140, 156

[56] References Cited

U.S. PATENT DOCUMENTS

| | | | |
|---|---|---|---|
| 2,679,045 | 5/1954 | Neumann | 227/76 |
| 3,016,538 | 1/1962 | Oussani | 227/110 |
| 3,510,044 | 5/1970 | Weidenfeld et al. | 227/78 |
| 3,934,776 | 1/1976 | Cruden, Jr. | 227/76 |
| 4,750,661 | 6/1988 | Pane | 227/78 |
| 5,626,275 | 5/1997 | Chen | 227/110 |

*Primary Examiner*—Scott A. Smith

[57] ABSTRACT

An adjustable twin stapler device has a base, a platform disposed on the base, a cover covering the platform, a first electric stapler disposed between the platform and the cover, a second electric stapler disposed between the platform and the cover, an electric circuit board, and an adjusting device disposed between the base and the platform. A push plate is disposed on the cover. The platform has a bottom plate. A first and a second columns are disposed on the bottom plate. The electric circuit board is disposed on the first and the second columns.

1 Claim, 2 Drawing Sheets

ADJUSTABLE TWIN STAPLER DEVICE

BACKGROUND OF THE INVENTION

The present invention relates to an adjustable stapler device. More particularly, the present invention relates to a twin stapler device.

Two conventional staplers cannot adjust the spacing between two staplers nor fix the positions of two staplers at the same time. Thus the user has to use a single stapler each time.

SUMMARY OF THE INVENTION

An object of the present invention is to provide an adjustable twin stapler device which have at least two staplers operated at the same time.

Another object of the present invention is to provide an adjustable twin stapler device which can adjust the spacing between two staplers easily.

Accordingly, an adjustable twin stapler device comprises a base, a platform disposed on the base, a cover covering the platform, a first electric stapler disposed between the platform and the cover, a second electric stapler disposed between the platform and the cover, an electric circuit board disposed on the platform, and an adjusting device disposed between the base and the platform. A push plate is disposed on the cover. The push plate has a protrusion, a protruded block, and a pointer. The cover has a plurality of hollow pillars, a periphery recess, a slot, a first cage hole, a second cage hole, a graduation, and a positioning recess. A first magnet coil is disposed on the first electric stapler. A first press cylinder is disposed on the first magnet coil. A second magnet coil is disposed on the second electric stapler. A second press cylinder is disposed on the second magnet coil. The platform has a bottom plate, an opening, and a notch. A first and a second columns are disposed on the bottom plate. The electric circuit board is disposed on the first and the second columns. An axle is disposed on a bottom of the bottom plate. A plurality of through holes are formed on the bottom plate. A plurality of rectangular holes are formed on the bottom plate. The adjusting device has a first positioning plate, a first serrated plate connected to the first positioning plate, a second positioning plate, a second serrated plate connected to the second positioning plate, and a gear. A plurality of first hollow props are disposed on the first positioning plate. A first serration is formed on the first serrated plate. A plurality of second hollow props are disposed on the second positioning plate. A second serration is formed on the second serrated plate. A push button is disposed on the second positioning plate. The base has a plurality of hollow posts, and a spacing. The push button is inserted in the notch. Each of the hollow posts matches each of the corresponding hollow pillars to be fastened by a corresponding screw respectively. The axle is inserted in a center of the gear. The protrusion is inserted in the slot. A screening plate is disposed in an upper portion of the cover to be engaged with the protrusion. The screening plate has an elastic arm. The elastic arm has a cage block to be inserted in the positioning recess. An elongated plate is extended downward from the screening plate. A movable lug and a micromotion switch are disposed on the elongated plate. Each of the first hollow props are inserted in each of the corresponding rectangular holes respectively. Each of the second hollow props are inserted in each of the corresponding rectangular holes respectively. The first hollow props and the first electric stapler are fastened together. The second hollow props and the second electric stapler are fastened together. The first serration engages with the gear. The second serration engages with the gear.

BRIEF DESCRIPTION OF THE DRAWINGS

FIG. I is a perspective exploded view of an adjustable twin stapler device of a preferred embodiment in accordance with the present invention.

DETAILED DESCRIPTION OF THE INVENTION

Figure 1:
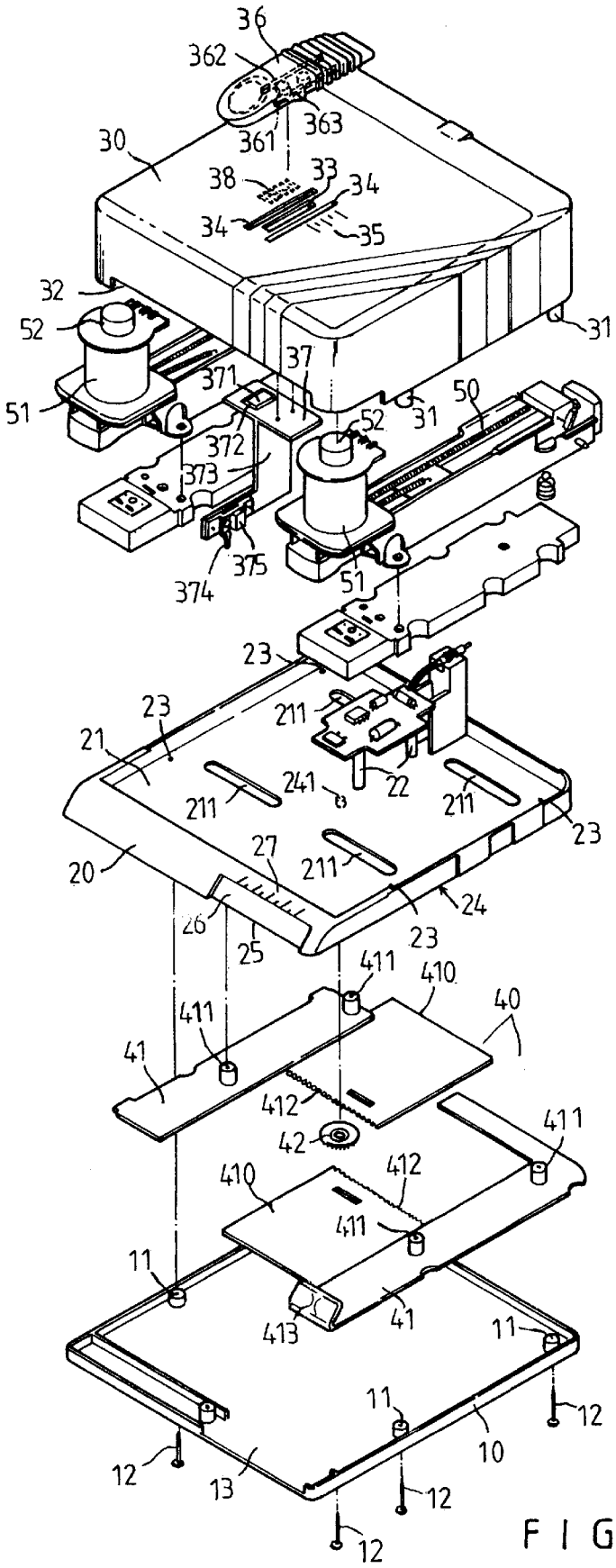
Figure 3:
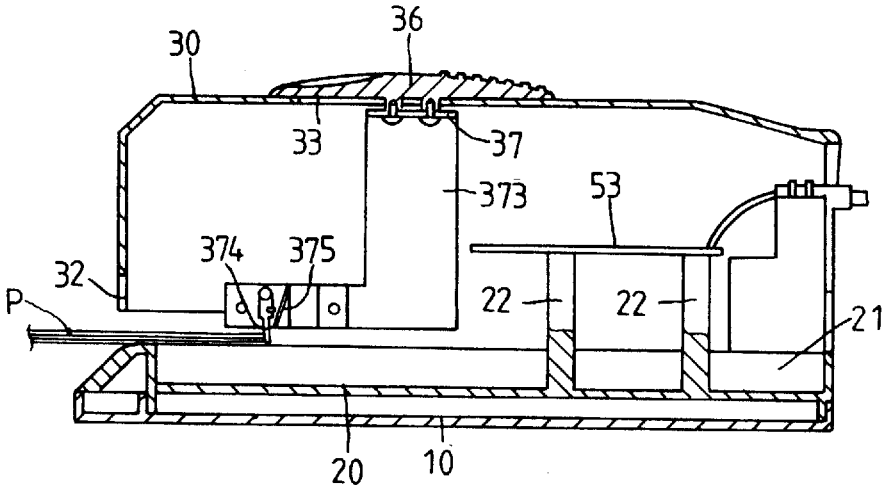
FIG. 3 is a sectional view of an adjustable twin stapler device of a preferred embodiment in accordance with the present invention.
Figure 2:
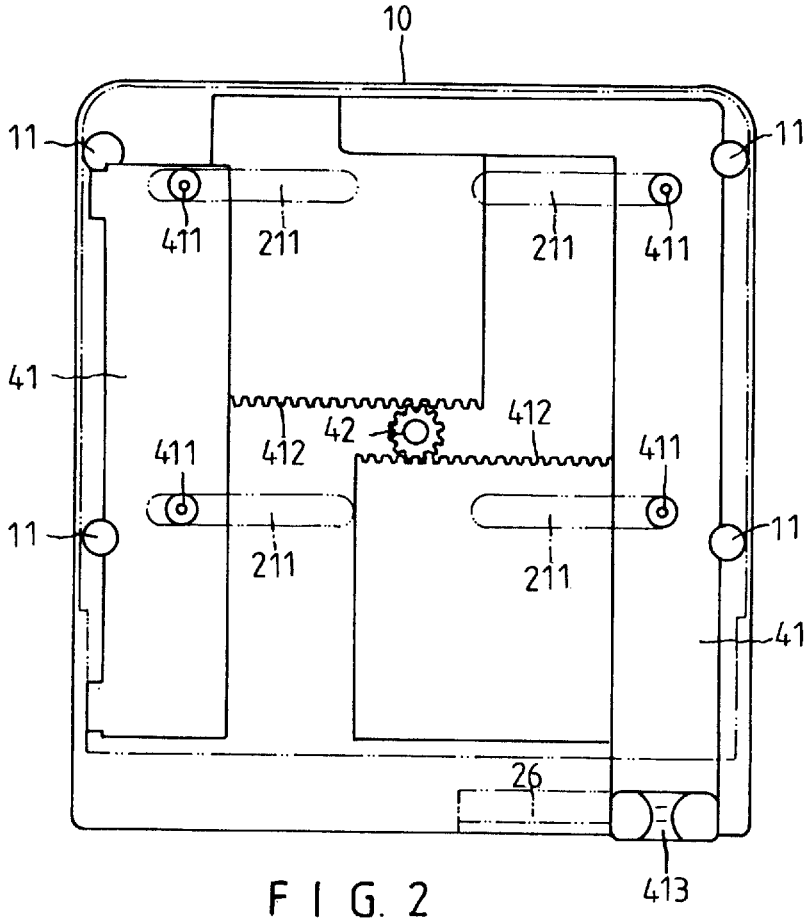
FIG. 2 is an elevational view of an adjustable twin stapler device of a preferred embodiment in accordance with the present invention.

Referring to FIGS. 1 to 3, an adjustable twin stapler device comprises a base 10, a platform 20 disposed on the base 10, a cover 30 covering the platform 20, a first electric stapler 50 disposed between the platform 20 and the cover 30, a second electric stapler 50 disposed between the platform 20 and the cover 30, an electric circuit board 53, and an adjusting device 40 disposed between the base 10 and the platform 20. A push plate 36 is disposed on the cover 30.

The push plate 36 has a protrusion 361, a protruded block 362, and a pointer 363.

The cover 30 has a plurality of hollow pillars 31, a periphery recess 32, a slot 33, a first cage hole 34, a second cage hole 34, a graduation 35, and a positioning recess 38.

A first magnet coil 51 is disposed on the first electric stapler 50. A first press cylinder 52 is disposed on the first magnet coil 51. A second magnet coil 51 is disposed on the second electric stapler 50. A second press cylinder 52 is disposed on the second magnet coil 51.

The platform 20 has a bottom plate 21, an opening 25, and a notch 26. A first and a second columns 22 are disposed on the bottom plate 21. The electric circuit board 53 is disposed on the first and the second columns 22. An axle 241 is disposed on a bottom 24 of the bottom plate 21. A plurality of through holes 23 are formed on the bottom plate 21. A plurality of rectangular holes 211 are formed on the bottom plate 21.

The adjusting device 40 has a first positioning plate 41, a first serrated plate 410 connected to the first positioning plate 41, a second positioning plate 41, a second serrated plate 410 connected to the second positioning plate 41, and a gear 42. A plurality of first hollow props 411 are disposed on the first positioning plate 41. A first serration 412 is formed on the first serrated plate 410. A plurality of second hollow props 411 are disposed on the second positioning plate 41. A second serration 412 is formed on the second serrated plate 410. A push button 413 is disposed on the second positioning plate 41. The base 10 has a plurality of hollow posts 11, and a spacing 13.

The push button 413 is inserted in the notch 26. Each of the hollow posts 11 matches each of the corresponding hollow pillars 31 to be fastened by a corresponding screw 12 respectively. The axle 241 is inserted in a center of the gear 42. A plurality of papers P are inserted in the periphery recess 32. The protrusion 361 is inserted in the slot 33. A screening plate 37 is disposed in an upper portion of the cover 30 to be engaged with the protrusion 361. The screening plate 37 has an elastic arm 371. The elastic arm 371 has a cage block 372 to be inserted in the positioning recess 38. An elongated plate 373 is extended downward from the screening plate 37. A movable lug 374 and a micromotion switch 375 are disposed on the elongated plate 373. The movable lug 374 is pressed by the papers P, and the movable lug 374 presses the micromotion switch 375. Each of the first hollow props 411 are inserted in each of the corresponding rectangular holes 211 respectively. Each of the second hollow props 411 are inserted in each of the corresponding rectangular holes 211 respectively. The first hollow props 411 and the first electric stapler 50 are fastened together. The second hollow props 411 and the second electric stapler 50 are fastened together. The first serration 412 engages with the gear 42. The second serration 412 engages with the gear 42.

When the papers P are inserted in the periphery recess 32 and presses the movable lug 374, the movable lug 374 presses the micromotion switch 375 to operate the first press cylinder 52 and the second press cylinder 52 to move downward.

The invention is not limited to the above embodiment but various modification thereof may be made. Further, various changes in form and detail may be made without departing from the scope of the invention.

I claim:

1. An adjustable twin stapler device comprising:

a base, a platform disposed on the base, a cover covering the platform, a first electric stapler disposed between the platform and the cover, a second electric stapler disposed between the platform and the cover, an electric circuit board, and an adjusting device disposed between the base and the platform, a push plate disposed on the cover, the push plate having a protrusion, a protruded block, and a pointer, the cover having a plurality of hollow pillars, a periphery recess, a slot, a first cage hole, a second cage hole, a graduation, and a positioning recess, a first magnet coil disposed on the first electric stapler, a first press cylinder disposed on the first magnet coil, a second magnet coil disposed on the second electric stapler, a second press cylinder disposed on the second magnet coil, the platform having a bottom plate, an opening, and a notch, a first and a second columns disposed on the bottom plate, the electric circuit board disposed on the first and the second columns, an axle disposed on a bottom of the bottom plate, a plurality of through holes formed on the bottom plate, a plurality of rectangular holes formed on the bottom plate, the adjusting device having a first positioning plate, a first serrated plate connected to the first positioning plate, a second positioning plate, a second serrated plate connected to the second positioning plate, and a gear, a plurality of first hollow props disposed on the first positioning plate, a first serration formed on the first serrated plate, a plurality of second hollow props disposed on the second positioning plate, a second serration formed on the second serrated plate, a push button disposed on the second positioning plate, the base having a plurality of hollow posts and a spacing, the push button inserted in the notch, each of the hollow posts matching each of the corresponding hollow pillars to be fastened by a corresponding screw respectively, the axle inserted in a center of the gear, the protrusion inserted in the slot, a screening plate disposed in an upper portion of the cover to be engaged with the protrusion, the screening plate having an elastic arm, the elastic arm having a cage block to be inserted in the positioning recess, an elongated plate extended downward from the screening plate, a movable lug and a micromotion switch disposed on the elongated plate, each of the first hollow props inserted in each of the corresponding rectangular holes respectively, each of the second hollow props inserted in each of the corresponding rectangular holes respectively, the first hollow props and the first electric stapler fastened together, the second hollow props and the second electric stapler fastened together, the first serration engaging with the gear, and the second serration engaging with the gear.

* * * * *